US005996261A

United States Patent [19]

Nelson

[11] Patent Number: 5,996,261

[45] Date of Patent: Dec. 7, 1999

[54] ARTICLE OF FOOTWEAR HAVING A STORAGE FACILITY

[76] Inventor: Mary K. Nelson, 106 Breeze Ave., Venice, Calif. 90291

[21] Appl. No.: 09/252,126

[22] Filed: Feb. 18, 1999

[51] Int. Cl.[6] ..... A43B 23/00

[52] U.S. Cl. ..... 36/136; 36/43

[58] Field of Search ..... 36/136, 165, 1, 36/43

[56] References Cited

U.S. PATENT DOCUMENTS

| | | |
|---|---|---|
| 654,388 | 7/1900 | Diemer . |
| 1,085,254 | 1/1914 | Halley . |
| 1,751,069 | 3/1930 | Blain . |
| 2,762,134 | 9/1956 | Town . |
| 3,631,613 | 1/1972 | Brettell . |
| 4,516,337 | 5/1985 | Adamik . |

FOREIGN PATENT DOCUMENTS

| | | |
|---|---|---|
| 1213038 | 3/1960 | France . |

*Primary Examiner*—Ted Kavanaugh
*Attorney, Agent, or Firm*—Robert E. Malm

[57] ABSTRACT

The invention is an article of footwear comprising a heel, an outer sole, an innersole, and an upper wherein a storage facility is incorporated in an interior part of the article. One type of storage facility consists of a chamber in the heel having at least one opening and a closure for each opening. One type of closure has a push button which, when pushed, causes the closure to be partially or completely ejected from the opening to the chamber. The closure may include a receptacle adapted to receive and hold an object for storage in the chamber. Other types of storage facilities are pockets on the interior surface of the upper and in the innersole.

18 Claims, 2 Drawing Sheets

ARTICLE OF FOOTWEAR HAVING A STORAGE FACILITY

CROSS-REFERENCE TO RELATED APPLICATIONS (Not applicable)

STATEMENT REGARDING FEDERALLY SPONSORED RESEARCH AND DEVELOPMENT (Not applicable)

BACKGROUND OF THE INVENTION

This invention relates generally to footwear and more specifically to footwear with storage capabilities.

Men, women, and children have always had a need to carry things with them wherever they go. This need was initially met simply by carrying them in their hands, slinging them over their shoulders, or carrying them in containers of some sort.

When clothes came along, pockets were invented and became the ultimate means for men and boys to carry things. Even so, the males of the species found it desirable to maintain a filing system of sorts for storing things in their pockets by resorting to containers such as billfolds and change purses. An added attraction of such containers was the protection provided the more fragile items that were carried about. The males also took advantage of the ubiquitous belt as a carrier of "must have" items such as sun glasses, pocket knives, and sometimes cash.

Pockets in clothes have never become popular with women and girls as a carrying resource. Instead the handbag became the essential accessory for carrying the multitude of different things that females need in living their daily lives. This has worked out well except for those times when it is inconvenient to carry and keep track of a handbag. There appears to be no completely satisfactory solution to this problem. The only options seem to be to cut down on the number of items that must be carried, thereby making the use of a small purse feasible.

Fashion-dictated changes in women's footwear has now provided a way of avoiding the use of any purse at all. It is now quite fashionable for many occasions to wear stylized boots with large heels, rather than the delicate "high heels" customarily the footwear of choice. These large heels provide a new resource for the storage of women's essentials.

BRIEF SUMMARY OF THE INVENTION

The invention is an article of footwear comprising a heel, an outersole, an innersole, and an upper wherein a storage facility is incorporated in an interior part of the article. One type of storage facility consists of a chamber in the heel having at least one opening and a closure for each opening. One type of closure has a push button which, when pushed, causes the closure to be partially or completely ejected from the opening to the chamber. The closure may include a receptacle adapted to receive and hold an object for storage in the chamber.

Another type of storage facility is a pocket on the interior surface of the upper. Still another type of storage facility is a pocket in the innersole with a flap covering the opening to the pocket.

DETAILED DESCRIPTION OF THE INVENTION

Figure 1:
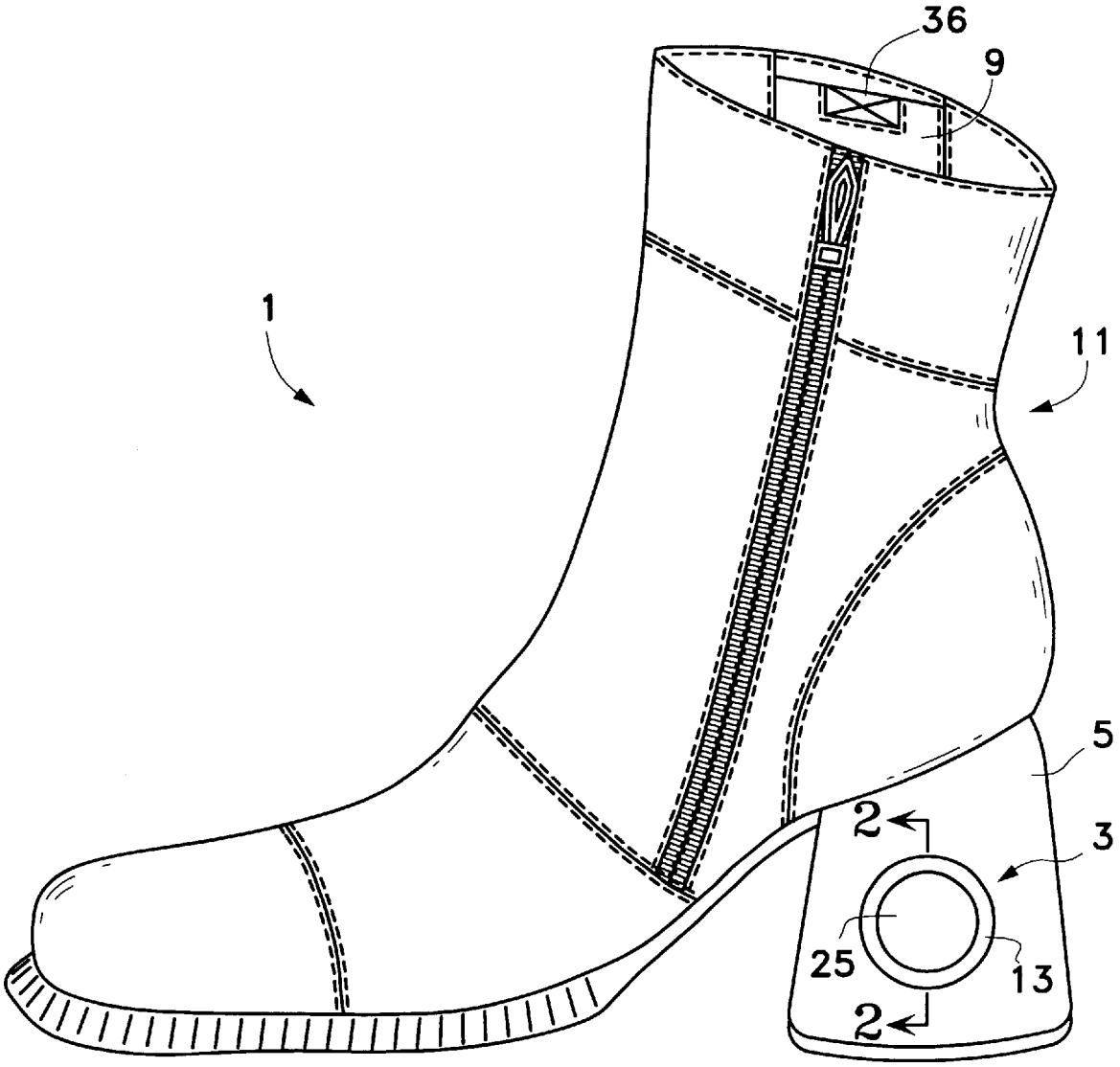
FIG. 1 provides a perspective view of the invention.

The invention is an article of footwear with a storage chamber in the heel and with one or more pockets on inside surfaces. A preferred embodiment of a boot-type article of footwear is shown in FIG. 1. The boot 1 includes a cylindrical storage chamber 3 within the heel 5, a push-to-release closure 13 within the storage chamber 3, an upper pocket 9 on the inside of the upper 11 of the boot 1, and a lower pocket (not shown) in the innersole.

The cylindrical storage chamber 3 extends from a side surface of the heel 5 to the vicinity of, but not through, the other side surface of the heel. The cylindrical form of the storage chamber 3 is preferred because of the ease of fabrication and also became of the roughly cylindrical form of the objects that may be stored within the chamber. However, there are no limitations to the shape of the chamber 3 except those imposed by the shape of the heel.

Figure 2:
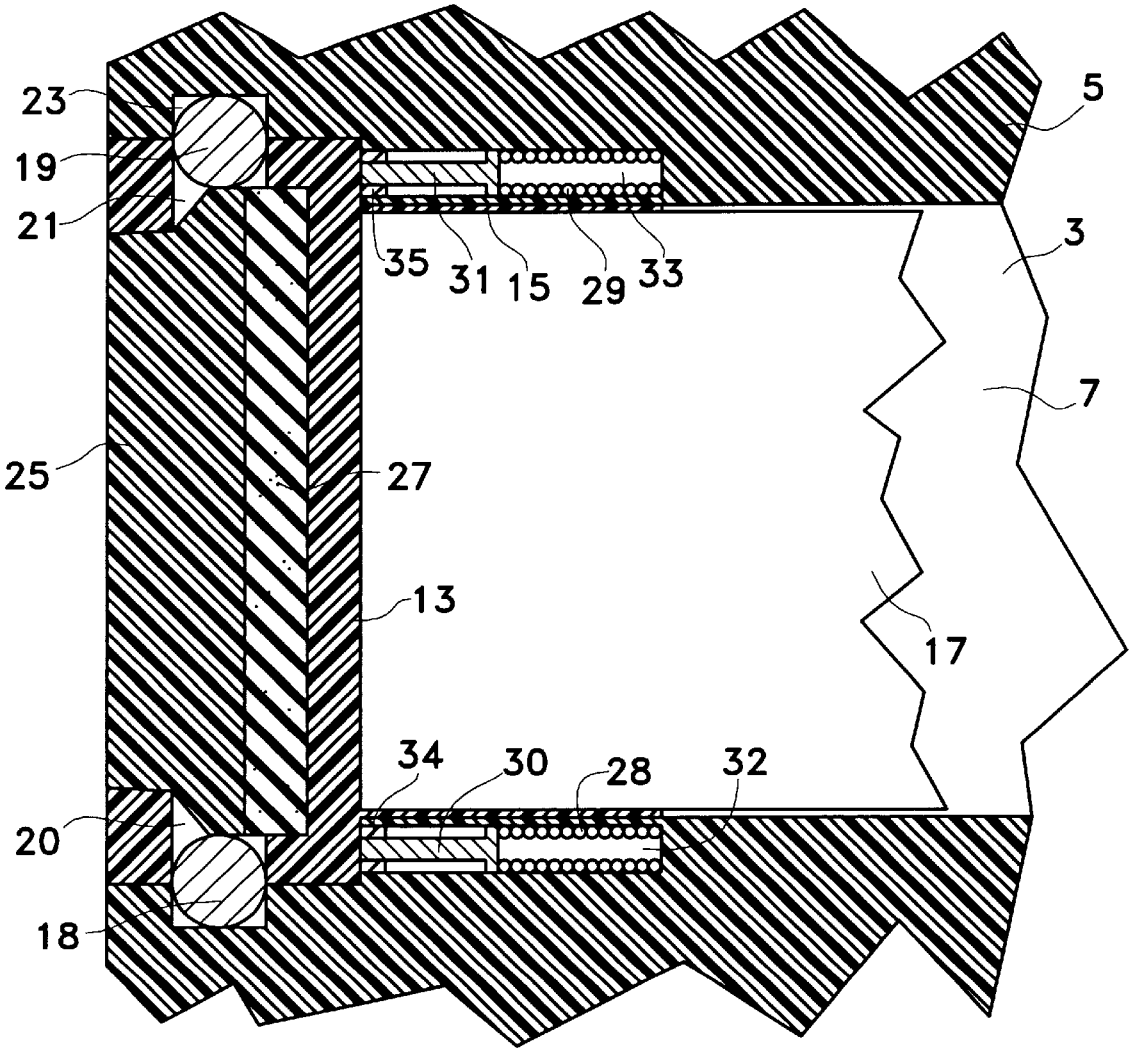
FIG. 2 provides a cross-sectional view of the closure to the heel cavity showing the outline of a lipstick attached to the closure.

A cross-sectional view of the push-to-release closure 13 locked in position within storage chamber 3 in heel 5 is shown in FIG. 2. Closure 13 includes an open cylindrical base 15 into which a replaceable article 17 can be introduced and-held by frictional forces. Likely candidates for being replaceable articles 17 are lipsticks, chapsticks, aspirin in lipstick-shaped containers, etc.

Closure 13 is held within chamber 3 by balls 18, 19 captured in holes 20, 21 and locked into groove 23 by push button 25. The push button 25 is held in the locking position by a disc-shaped elastomer 27. The closure 13 is removed from the chamber 3 by a person pressing on the push button 25 which allows the balls 18, 19 to move out of groove 23. When the push button is 25 is released, coil springs 28, 29, which are exerting forces against pins 30, 31, cause the closure 13 to be pushed partially out of chamber 3. At this point, the person can grip the end of closure 13 and extract it from chamber 3. The springs 28, 29 and pins 30, 31 are prevented from coming out of holes 32, 33 by fixed collars 34, 35.

The closure 13 is returned to the chamber 3 by pushing the push button 25 until the closure 13 is seated in chamber 3 and then releasing push button 25 while holding closure 13 in a seated position.

The upper pocket 9 is formed by sewing three sides of a rectangular piece of lining material to the lining of the upper 11 leaving the top side open. The pocket is provided with a VELCRO® hook-and-loop type closure 36. The pocket 9 is dimensioned for credit cards, driving license, etc.

Figure 3:
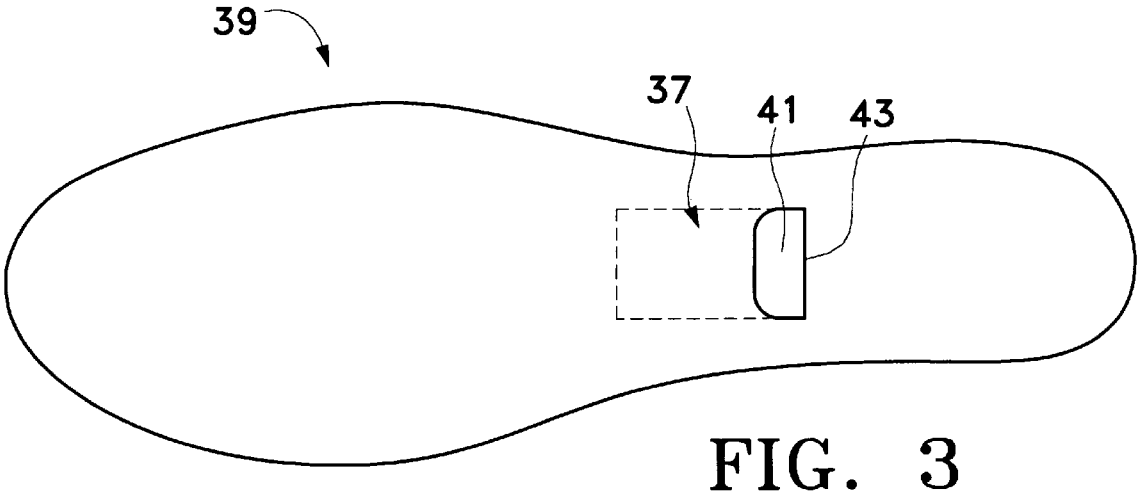
FIG. 3 is a top view of the innersole showing a flap that covers the entrance to a pocket.

A lower pocket 37 is provided by a thin cavity in innnersole 39 of boot 1, as shown in FIG. 3. Pocket 37 is also dimensioned for credit cards and like-sized objects and is located just beneath the arch of the foot. The entry to the pocket is covered by a flap 41 which is flush with the surface of innersole 39. Flap 41 is attached to innersole 39 along line 43.

What is claimed is:

1. An article of footwear comprising a heel, an outer sole, an innersole, and an upper, the article also comprising one or more storage facilities in an interior part of the article, at least one of the storage facilities being a chamber in the heel having at least one opening and a closure for each opening, a slidable closure being associated with at least one opening, the slidable closure slidably entering the associated opening parallel to a slide axis to close the opening, the article of footwear further comprising:

a latch in the slidable closure that exists in either an activated state or a latched state, a latch in the activated state allowing the slidable enclosure to move freely into and out of the associated opening, a latch in the latched state holding the slidable enclosure within the enclosure immovable at a latching position;

a depressible push button mounted in the slidable closure and linked to the latch, a depressed push button corresponding to a latch in the activated state, an undepressed push button corresponding to a latch in the latched state.

2. The article of claim 1 wherein the closure comprises:

a receptacle adapted to receive and hold an object for storage in the chamber.

3. The article of claim 1 wherein a storage facility comprises:

a pocket on the interior surface of the upper comprising an essentially rectangular piece of material attached on three sides to the interior surface of the upper, a means being provided to attach and disattach the fourth side of the piece of material to the interior surface of the upper.

4. The article of footwear of claim 3 wherein the means provided to attach the fourth side of the piece of material to the interior surface of the upper is a hook-and-loop type closure.

5. The article of claim 1 wherein a storage facility comprises:

an essentially rectangular pocket in the innersole, the pocket being located substantially in its entirety beneath the arch of the foot of the user.

6. The article of claim 5 wherein the storage facility comprises:

a flap covering the opening to the pocket, the flap being flush with the surface of the innersole.

7. The article of footwear of claim 1 further comprising:

an ejector that ejects the slidable closure from the associated opening after a momentary force is applied to the push button.

8. The article of footwear of claim 7 wherein the ejector exerts an ejection force on the slidable closure whenever the slidable closure is within a specified distance of its latching position.

9. The article of footwear of claim 8 wherein an ejection force greater than zero is exerted on the slidable closure by the ejector whenever the slidable closure is within a specified distance of the latching position, the force discontinuously changing to zero when the distance of the slidable closure from the latched position reaches the specified distance.

10. The article of footwear of claim 8 wherein the specified distance is less than the length of the push button measured parallel to the slide axis.

11. The article of footwear of claim 8 wherein the ejection force is exerted at a plurality of discrete points around the periphery of the slideable closure.

12. The article of footwear of claim 7 wherein the ejector pushes the slidable closure partially but not completely out of the associated opening when a momentary force is applied to the push button.

13. The article of footwear of claim 7 wherein the ejector is contained within the heel.

14. The article of footwear of claim 1 wherein one or more receptacles are incorporated in the interior surface of the opening associated with the slidable closure, the latch comprising:

one or more latching members slidably contained in the slidable closure, each latching member being associated with a receptacle, the latching members entering the associated receptacles when the slidable closure is at the latching position and the latch transitions from the activated state to the latched state.

15. The article of footwear of claim 14 wherein the push button causes the one or more latching members to enter the associated one or more receptacles by direct contact with the latching members.

16. The article of footwear of claim 1 wherein a momentary force on the push button while the slidable closure is being pushed into the associated opening causes the latch to transition from the latched state to the activated state, the latch automatically transitioning from the activated state to the latched state when the slidable closure reaches the latching position.

17. The article of footwear of claim 1 wherein the latch transitions automatically from the activated state to the latched state when the slidable closure is at the latching position.

18. The article of footwear of claim 1 wherein the push button is elastically constrained within the slidable closure, an undepressed push button preventing the latch from transitioning from the latched state to the activated state.

* * * * *